US006990710B2

(12) United States Patent
Kunz et al.

(10) Patent No.: US 6,990,710 B2
(45) Date of Patent: Jan. 31, 2006

(54) COUNTERBALANCE SYSTEM FOR A TILT-IN WINDOW HAVING AN IMPROVED SHOE ASSEMBLY AND ANCHOR MOUNT

(76) Inventors: John R. Kunz, 410 Glenwood Dr., Douglassville, PA (US) 19518; Keith Kannengieszer, 2517 Wellington Way, Hatfield, PA (US) 19440

( * ) Notice: Subject to any disclaimer, the term of this patent is extended or adjusted under 35 U.S.C. 154(b) by 0 days.

(21) Appl. No.: 10/700,423

(22) Filed: Nov. 5, 2003

(65) Prior Publication Data

US 2005/0091791 A1 May 5, 2005

(51) Int. Cl.
*E05F 1/00* (2006.01)
*E05F 3/00* (2006.01)

(52) U.S. Cl. ..... 16/193; 16/197; 49/181

(58) Field of Classification Search ..... 16/193–197, 16/198; 49/181, 176, 183, 445, 446, 463, 49/414, 419; 160/98, 191, 207
See application file for complete search history.

(56) References Cited

U.S. PATENT DOCUMENTS

| | | | | | |
|---|---|---|---|---|---|
| 2,635,282 | A | * | 4/1953 | Trammell, Sr. et al. | 16/197 |
| 2,684,499 | A | * | 7/1954 | Lewis | 16/197 |
| 3,452,480 | A | * | 7/1969 | Foster | 49/445 |
| 3,869,754 | A | * | 3/1975 | Foster | 16/197 |
| 4,227,345 | A | * | 10/1980 | Durham, Jr. | 49/181 |
| 4,610,108 | A | * | 9/1986 | Marshik | 49/181 |
| 4,953,258 | A | * | 9/1990 | Mennuto | 16/197 |
| 4,961,247 | A | * | 10/1990 | Leitzel et al. | 16/197 |
| 5,157,808 | A | * | 10/1992 | Sterner, Jr. | 16/197 |
| 5,210,976 | A | * | 5/1993 | Cripps | 49/181 |
| 5,243,783 | A | * | 9/1993 | Schmidt et al. | 49/181 |
| 5,301,467 | A | * | 4/1994 | Schmidt et al. | 49/181 |
| 5,353,548 | A | * | 10/1994 | Westfall | 49/446 |
| 5,371,971 | A | * | 12/1994 | Prete | 49/380 |
| 5,632,117 | A | * | 5/1997 | Prete et al. | 49/181 |
| 5,669,180 | A | * | 9/1997 | Maier | 49/181 |
| 5,806,243 | A | * | 9/1998 | Prete et al. | 49/181 |
| 5,829,196 | A | * | 11/1998 | Maier | 49/181 |
| 6,088,880 | A | * | 7/2000 | LaSee | 16/366 |
| 6,151,832 | A | * | 11/2000 | Opielski et al. | 49/181 |
| 6,230,443 | B1 | * | 5/2001 | Schultz | 49/183 |
| 6,550,184 | B1 | * | 4/2003 | O'Donnell et al. | 49/181 |
| 6,606,761 | B2 | * | 8/2003 | Braid et al. | 16/197 |

FOREIGN PATENT DOCUMENTS

| | | | |
|---|---|---|---|
| CA | 2382790 | A1 * | 8/2003 |
| DE | 10107696 | A1 * | 9/2002 |

* cited by examiner

*Primary Examiner*—Chuck Y. Mah
(74) *Attorney, Agent, or Firm*—Lamorte & Associates

(57) ABSTRACT

A counterbalance system for a tilt-in window having novel components. The counterbalance system includes brake shoes, curl springs and spring anchor mounts. The brake shoe assembly of the counterbalance system has a unique, low cost locking mechanism that uses a looped wire. The brake shoe assembly may also be configured with external rib projections that reduce the friction of the brake shoe assemblies as they move through the tracks of the window. The spring anchor mount is formed with a recess in its body that enables the tilt latch of a window sash to pass the spring anchor mount within the track of the window frame. As a result, the spring anchor mounts can be placed within the window frame at points previously not available.

11 Claims, 6 Drawing Sheets

COUNTERBALANCE SYSTEM FOR A TILT-IN WINDOW HAVING AN IMPROVED SHOE ASSEMBLY AND ANCHOR MOUNT

BACKGROUND OF THE INVENTION

1. Field of the Invention

In general, the present invention relates to counterbalance systems for windows that prevent open window sashes from closing under the force of their own weight. More particularly, the present invention system relates to counterbalance systems for tilt-in windows that use curl springs to create a counterbalancing force.

2. Description of the Prior Art

There are many types and styles of windows. One of the most common types of window is the double-hung window. A double-hung window is the most common window found in traditional home construction. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

The sash of a double-hung window has a weight that depends upon the materials used to make that window sash and the size of the window sash. Since the sashes of a double-hung window are free to move up and down in the frame of a window, some counterbalancing system must be used to prevent the window sashes from always moving to the bottom of the window frame under the force of their own weight.

For many years counterbalance weights were hung next to the window frame in weight wells. The weights were attached to the window sash using a string or chain that passed over a pulley at the top of the window frame. The weights counterbalanced the weight of the window sashes. As such, when the sashes were moved in the window frame, they had a neutral weight and friction would hold them in place.

The use of weight wells, however, prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame and did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame, tilt-in, double-hung windows are typically manufactured with tracks along the inside of the window frame. Brake shoe mechanisms, commonly known as "shoes" in the window industry, are placed in the tracks and ride up and down within the tracks. Each sash of the window has two tilt pins or tilt posts that extend into the shoes and cause the shoes to ride up and down in the tracks as the window sashes are opened or closed.

The shoes serve two purposes. First, the shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Second, the shoes either support or engage curl springs. Curl springs are constant force coil springs that supply a constant retraction force when unwound.

Single curl springs are used on windows with light sashes. Multiple curl springs are used on windows with heavy sashes. The curl springs provide the counterbalance force to the window sashes needed to maintain the sashes in place. The counterbalance force of the curl springs is transferred to the window sashes through the structure of the shoes and the tilt posts that extend from the window sash into the shoes.

The curl springs are utilized within the structure of a tilt-in window in two distinct operating systems. In the first operating system, the curl spring moves with the window sash as the window sash moves up and down in the window frame. In the second operating system, the curl spring is fixed and does not move with the window sash.

In the first operating system, where the curl spring moves, the end of the curl spring is anchored to the fixed part of the window frame. The remaining coils of the curl spring are supported by the shoe and move in unison with the shoe. As each shoe moves away from the anchor point, the curl spring unwinds. Conversely, as each brake shoe moves toward the anchor point, the curl spring rewinds. Such an operating system requires that the anchor mounts be set into the tracks of the windows so that the free ends of the curl springs can be anchored to the window frame. However, the presence of the anchor mount in the window track presents a problem to the free movement of the sashes. Often the movement of a window sash must be limited so that it does not contact the anchor mounts that are present. This often prevents a window sash from being able to open as fully as would otherwise be expected.

Another problem that is inherent to many window counterbalance systems is the complexity of the shoes that retain the springs and move with the springs in the tracks of the window frame. Of the various components that create a counterbalance system, one of the most expensive components is the shoe. The shoes must contain a brake mechanism strong enough to lock a window sash in place. In addition, the shoes must engage and retain at least one strong curl spring. Furthermore, the shoe must remain reliable for years of operation. Accordingly, prior art shoes are built with large, wear resistant components that tend to make the prior art shoes expensive and complex to manufacture.

A need therefore exists in the field of vinyl, tilt-in, double-hung windows, for a counterbalance system that has an improved spring anchor mounting assembly that does not limit the movement of window sashes. A need also exists in the field of vinyl, tilt-in double-hung windows for a counterbalance system that provides inexpensive shoe assemblies. As such, window assemblies can be made to be more reliable, less expensive and easier to manufacture. These needs are met by the present invention as described and claimed below.

SUMMARY OF THE INVENTION

The present invention is a counterbalance system for a tilt-in window. The counterbalance system includes brake shoes, curl springs and spring anchor mounts. The brake shoe assembly of the counterbalance system has a unique, low cost locking mechanism that uses a looped wire. The brake shoe assembly may also be configured with external rib projections that reduce the friction of the brake shoe assemblies as they move through the tracks of the window.

The spring anchor mount is formed with a recess in its body that enables the tilt latch of a window sash to pass the spring anchor mount within the track of the window frame. As a result, the spring anchor mounts can be placed within the window frame without concern of contact interference with the tilt latch. The result is a lower cost, more reliable counterbalance system for a window that provides a greater degree of movement in the window sashes so that the window sashes can be opened wider than previously possible.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
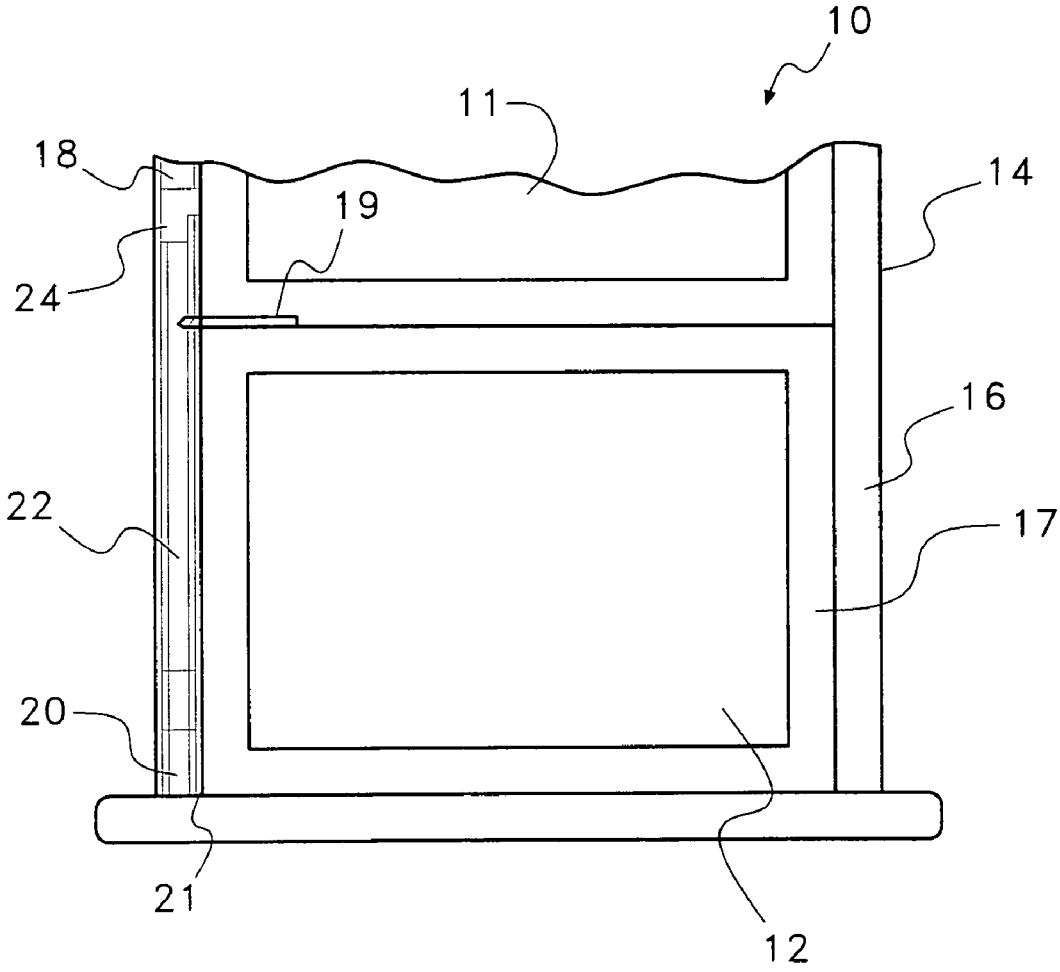
FIG. 1 is a partially fragmented view of a window assembly in accordance with the present invention.

Referring to FIG. 1, there is shown an exemplary embodiment of a vinyl, tilt-in, double-hung window assembly 10. The window assembly 10 has an upper sash 11 and a lower sash 12. Each of the sashes 11, 12 has two side elements 17. The upper sash 11 and the lower sash 12 are contained within a window frame 14. The window frame 14 has two vertical sides 16 that extend along the side elements 17 of both sashes 11, 12. Within each of the vertical sides 16 of the window frame 14 is formed a track 18.

At the top of each sash 11, 12 are two tilt latches 19 that extend a predetermined distance into the tracks 18 on the side of each sash 11, 12. The tilt latches 19 are used to disengage the top of a window sash 11, 12 from the track 18 so that the top of a window sash 11, 12 can be tilted inwardly for cleaning.

At the bottom of each of the sashes 11, 12 is a tilt pivot post 21 that also extends into the track 18. When a sash 11, 12 is tilted inwardly, the sash 11, 12 tilts about its tilt pivot posts 21. The tilt pivot posts 21 are received by shoe assemblies 20 that ride up and down within the tracks 18. The shoe assemblies 20 support at least one curl spring 22. The free end of each curl spring 22 is attached to the track 18 via a spring anchor mount 24.

In the prior art, an anchor mount of a curl spring for a particular sash would often have to be mounted below the tilt latch for that sash. In that way, the tilt latch would not have to pass the anchor mount as the window sash moved up and down in the track.

In the shown embodiment, the spring anchor mount 24 is attached to the track 18 above the tilt latch 19. As such, the tilt latch 19 passes the spring anchor mount 24 as the window sash 12 is moved up and down. However, as will later be described, the structure of the spring anchor mount 24 allows the tilt latch 19 to travel past the spring anchor mount 24 without interference. The window sash 12 is therefore capable of opening wider than many prior art window configurations.

Figure 2:
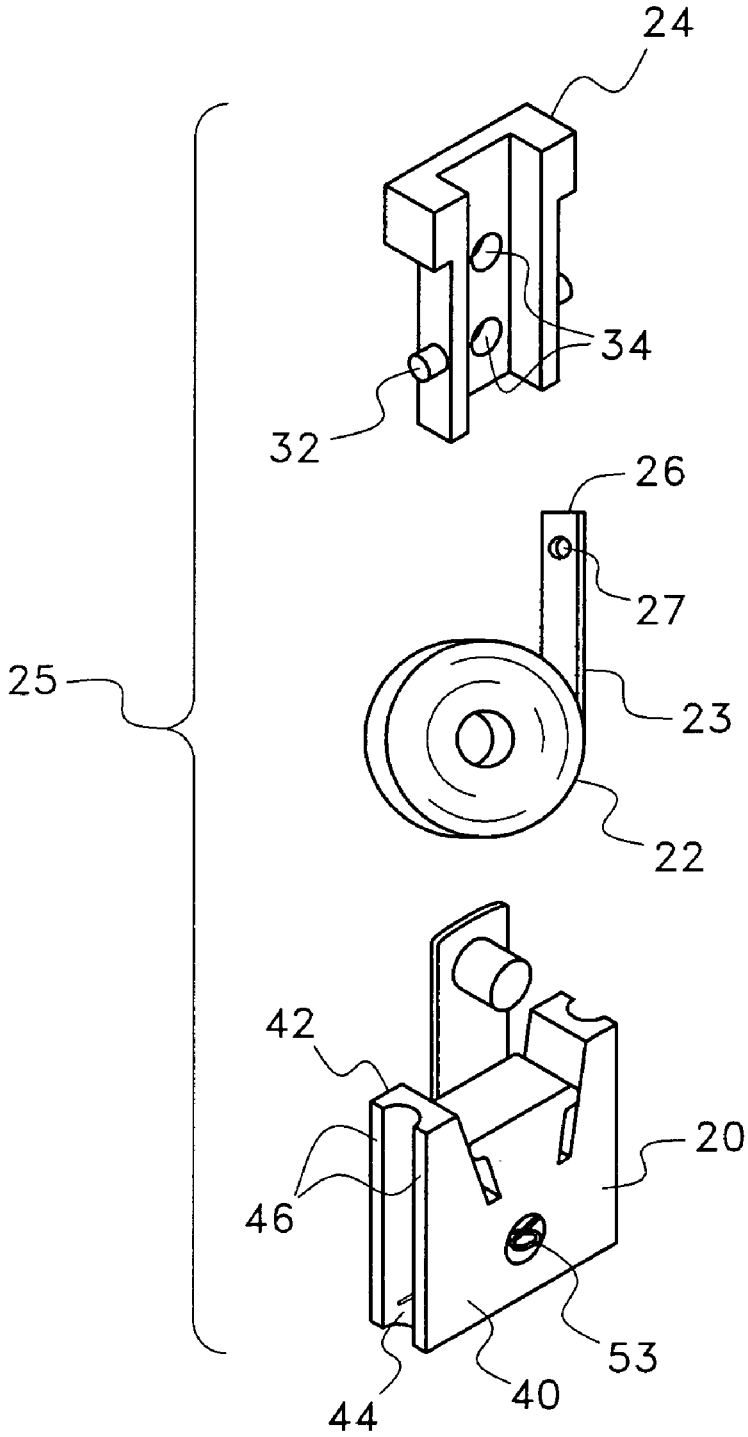
FIG. 2 is an exploded perspective view of the components of the present invention counterbalance system.

Referring to FIG. 2, it can be seen that the present invention counterbalance system 25 is comprised of a plurality of interconnecting components. These components include a shoe assembly 20, a spring anchor mount 24 and at least one curl spring 22. The shoe assembly 20 contains a brake mechanism that locks the shoe assembly 20 in place in the window track whenever the window sash is tilted. The functionality of the brake mechanism will later be explained. One shoe assembly 20 is provided for each side of a window sash.

At least one curl spring 22 is also provided for each side of a window sash. The curl springs 22 provide the tension force that is used to counterbalance the weight of a window sash as it is moved in a window frame. Each curl spring 22 is a length of ribbon steel 23 that is wound in a circular coil. The curl spring 22 applies a generally constant retraction force when the free end 26 of the ribbon steel is pulled away from the coil. The number of curl springs 22 used depends upon the size and weight of the window sash that is to be counterbalanced. Small window sashes may require only a single curl spring 22. Larger window sashes require multiple curl springs 22. In most standard windows, between one and four curl springs 22 are used.

The free end 26 of each curl spring 22 contains a mounting feature, such as a mount hole 27 or a barb that enables the free end 26 of the curl spring 22 to be readily mounted to the spring anchor mount 24.

Each spring anchor mount 24 has at least one side surface that contains a retaining structure 32 for receiving and engaging the free end 26 of the steel ribbon 23 of the curl spring 22. In the shown embodiment, each curl spring 22 is terminated with a mount hole 27. Accordingly, the side surface of the spring anchor 24 includes a retaining structure 32 in the form of a protrusion that is sized to pass into and engage the mount hole 27. Such a configuration is only one of many ways to interconnect the curl spring 22 to the spring anchor mount 24. It will be understood that if the free end 26 of the curl spring 22 were terminated with a screw hole, threaded bores would be present in the spring anchor mount that would enable the free end 26 of the curl spring 22 to be connected to the spring anchor mount 24 with a screw.

In the shown embodiment, each spring anchor mount 24 is capable of engaging and retaining the free end 26 of up to four curl springs 22. Most vinyl window counterbalance systems use between one and four curl springs. As such, a single spring anchor mount 24 is capable of engaging the curl springs of the most common counterbalance configurations.

Each spring anchor mount 24 has an attachment structure that enables the spring anchor mount to be attached to the track in the window frame. In the shown embodiment, the spring anchor mount 24 defines mounting holes 34 that enable the spring anchor mount 24 to be directly mounted to the window frame with screws. As will be later described, alternate attachment structures can be used to lock the spring anchor mount 24 into a set position. The details of the configuration of the spring anchor mount 24 is later described when referencing FIG. 6 and FIG. 7.

In FIG. 2, it can be seen that the shoe assembly 20 has a body that has a face surface 40 and a rear surface 42 disposed between two opposing side surfaces 44. When the shoe assembly 20 is connected to a curl spring 22 within a window frame track, the curl spring 22 commonly applies a slight torque to the shoe assembly 20. This causes the side surfaces 44 of the shoe assembly 20 to contact the track as the shoe assembly 20 moves within the confines of the track. To reduce the amount of friction caused by this contact, at least one rib protrusion 46 is optionally formed on the side surfaces 44. The rib protrusions 46 contact the window frame track and reduce the amount of surface area on the shoe assembly 20 that is in contact with the track. By reducing the surface area in contact, the amount of friction is also reduced.

The rib protrusions 46 can be molded of wear resistant material and added to the side surfaces 44 of the shoe assembly 20. However, in a preferred method of manufacturing, the rib protrusions 46 are molded as part of the shoe assembly 20.

Figure 3:
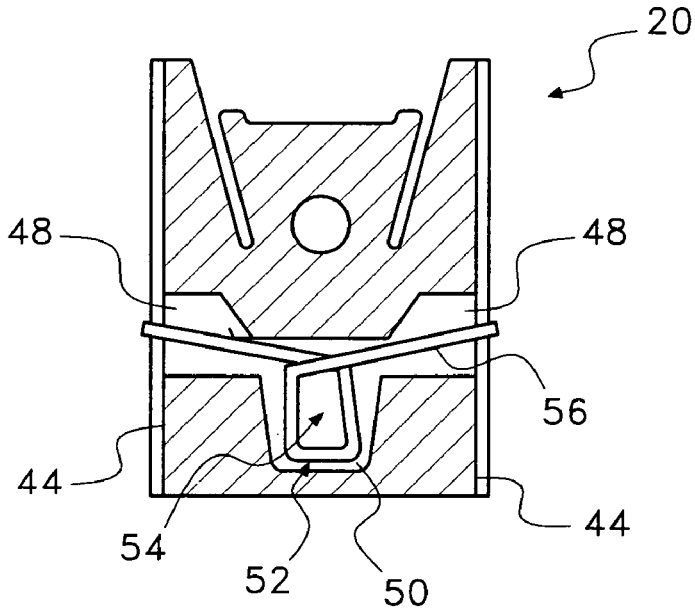
FIG. 3 is a cross-sectional view of an exemplary embodiment of a shoe assembly component of the counterbalance system.

Referring to FIG. 3, a cross-section of the shoe assembly 20 is shown. From FIG. 3, it can be seen that on the side surfaces 44 of the shoe assembly 20 are two side openings 48. The side openings 48 interconnect with an internal chamber 50. A post access hole 53 (FIG. 2) is formed in the face surface of the shoe assembly 20 that extends into the center of the internal chamber 50. Disposed within the internal chamber 50 and side openings 48 is a single loop torsion spring 52. The single loop torsion spring 52 is made of a spring wire that travels in one direction, is looped around and continues in that same general direction. The loop 54 in the center of the torsion spring 52 lays in the internal chamber 50 of the shoe assembly 20, while the arms 56 of the torsion spring 52 extend into the side openings 48. The loop 54 of the torsion spring 52 defines a central open area that is aligned with the post access hole 53 (FIG. 2) in the face surface of the shoe assembly 20.

The central open area defined by loop 54 of the torsion spring 52 is elongated, where the loop 54 is taller than it is wide. When the shoe assembly 20 is assembled into a window, the pivot arm of a window sash passes into the post access hole 53 (FIG. 2) in the shoe assembly 20 and then passes into the central open area defined by the loop 54 of the torsion spring 52.

Figure 4:
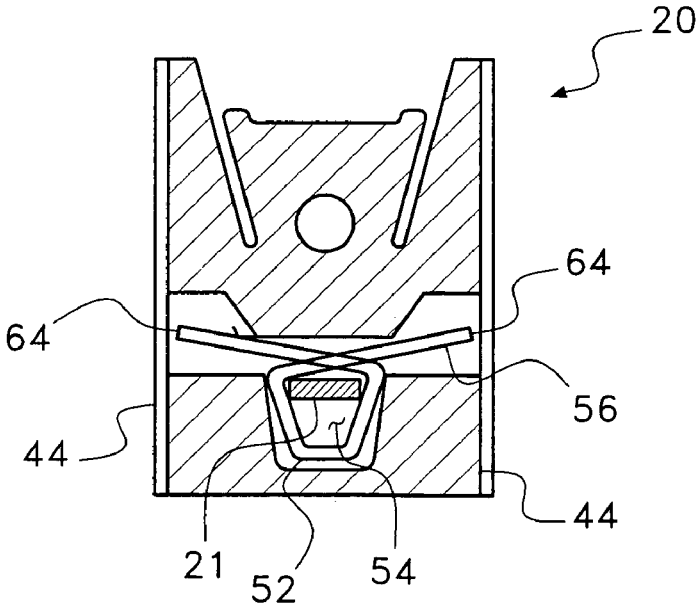
FIG. 4 is a cross-sectional view of an exemplary embodiment of the shoe assembly component of FIG. 3, shown engaging the pivot post of an untilted window sash.

It is well known in the art of tilt-in windows, that the pivot arms that extend from window sashes typically have non-round cross-sectional profiles. Most commonly, such pivot arms have a rectangular or otherwise oblong configuration. Referring to FIG. 4, it can be seen that when the pivot arm 21 of a window sash is disposed in the loop 54 of the torsion spring 52, the presence of the pivot arm 21 deforms the loop 54 and expands the loop 54. Due to the configuration of the torsion spring 52, as the loop 54 is expanded, the arms 56 of the torsion spring 52 retract into the body of the shoe assembly 20. Accordingly, the ends 64 of the torsion spring 52 do not extend out of the body of the shoe assembly 20.

Since the ends 64 of the torsion spring 52 do not extend out beyond the side surfaces 44 of the shoe assembly 20, the shoe assembly 20 is free to move up and down in the track defined by the vinyl window frame. The pivot arm 21 expands the torsion spring 52 and retracts the arms of the torsion spring 52 when the window sash is flush in the window frame. Thus, when the window sash is moved up and down in the window's track, the shoe assembly 20 provides little resistance to the movement.

Figure 5:
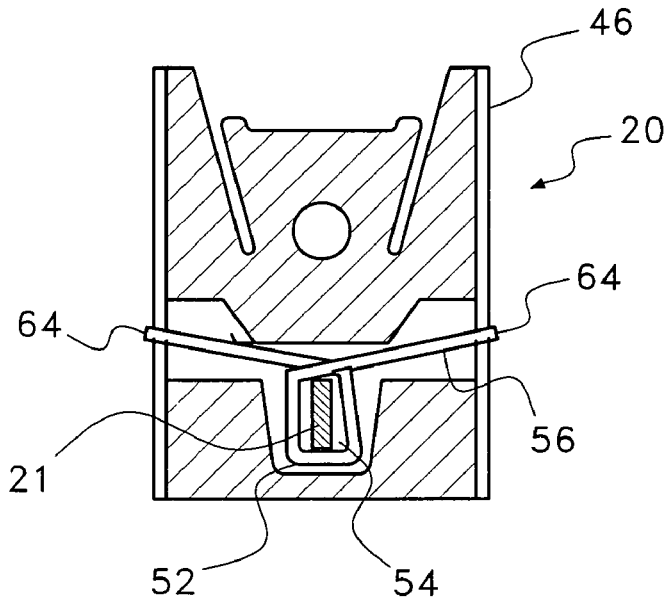
FIG. 5 is a cross-sectional view of an exemplary embodiment of the shoe assembly component of FIG. 3, shown engaging the pivot post of a tilted window sash.

However, when the window sash is tilted inwardly out of the plane of the window frame, the pivot arm 21 in the torsion spring 52 rotates with the window sash. Referring to FIG. 5, it can be seen that when the window sash is tilted, the pivot arm 21 turns and no longer expands the loop 54 in the center of the torsion spring 52. With the pivot arm 21 no longer a barrier, the loop 54 contracts. As the loop 54 contracts, the arms 56 of the torsion spring 52 extend outwardly from the side surfaces 44 of the shoe assembly 20. The ends 64 of the arms 56 extend past the rib protrusions 46 and directly engage the walls of the track in which the shoe assembly 20 moves. The ends 64 of the arms 56 bite into the vinyl and lock the shoe assembly 20 into a fixed position within the track. It will, therefore, be understood that the torsion spring 52 is a brake mechanism. When the sash of a window is in the plane of the window frame, the arms 56 of the torsion spring 52 are retracted and the shoe assembly 20 can travel freely up and down the window frame. However, as soon as the window sash is tilted, the arms 56 of the torsion spring 52 extend and the arms 56 engage the surrounding track of the window frame, thereby locking the shoe assembly 20 into a set position within the track.

From the description of the function of the brake mechanism created by the torsion spring 52, it will be understood that the torsion spring 52 itself is a single, inexpensive component with no secondary moving parts. As such, the torsion spring 52 is a highly reliable brake mechanism that resists wear much better than prior art shoe assemblies that contain complex brake mechanisms with multiple moving parts.

Figure 6:
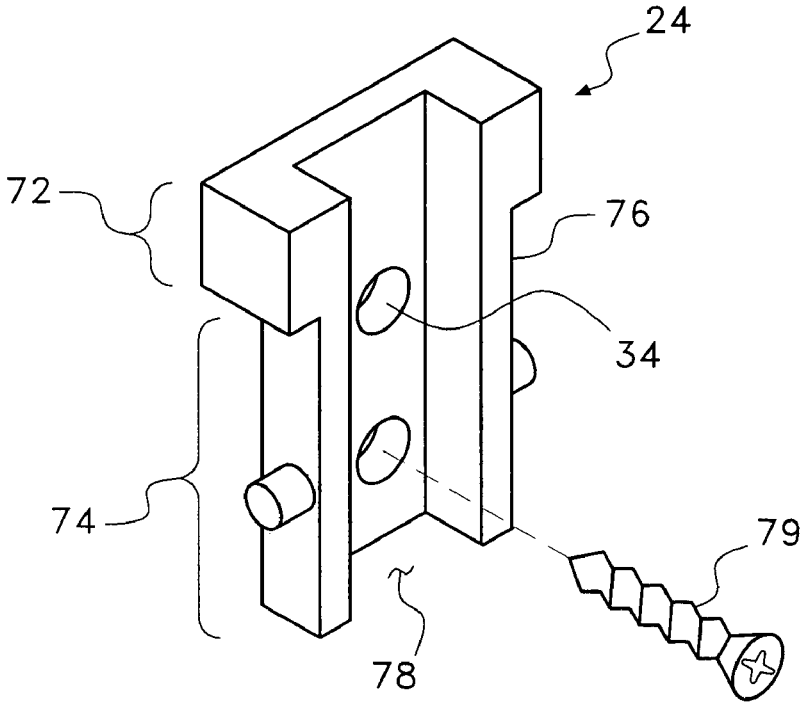
FIG. 6 is a perspective view of a first exemplary embodiment of a spring anchor mount in accordance with the present invention.

Referring to FIG. 6, a first embodiment of the spring anchor mount 24 is shown. The spring anchor mount 24 is preferably molded or machined as a single piece. The spring anchor mount 24 has a head section 72 that is sized to just fit within the track of a window. A body section 74 extends below the head section 72. The body section 74 is recessed and has a cross-sectional area smaller than that of the head section 72. Accordingly, the side walls 76 of the body section 74 of the spring anchor mount 24 do not contact the side walls of the window track when the spring anchor mount 24 is placed in the window track.

A recess 78 is formed in the face surface of the spring anchor mount 24. The recess 78 extends from the top to the bottom of the spring anchor mount 24 passing through both the head section 72 and the body section 74 of the spring anchor mount 24. The recess thins the center of the spring anchor mount 24. Preferably, the recess 78 in the head section 72 reduces the thickness of the head section 72 by at least thirty percent and may be as much as seventy percent.

At least one countersunk screw hole 34 is formed through the spring anchor mount 24 in the area of the recess 78. Mounting screws 79 are provided to attach the spring anchor mount 24 to a surface of the window track through the screw holes 34. Due to the countersunk screw holes 34 and shape of the mounting screws 79, it will be understood that the screws lay flush in the recess 78 and do not protrude into the area of the recess 78.

Referring back briefly to FIG. 1 in conjunction with FIG. 6, it will be understood that the recess 78 formed in the spring anchor mount 24 allows the tilt latch 19 that protrudes from the top of the sash 12 to pass the spring anchor mount 24 without contacting the spring anchor mount 24. On different model windows, the tilt latch 19 extends into the window track 18 by varying amounts. The recess 78 formed in the spring anchor mount 24 is larger than the protrusion of the tilt latch 19 by at least $1/32^{nd}$ of an inch so as to prevent any inadvertent contact.

Figure 7:
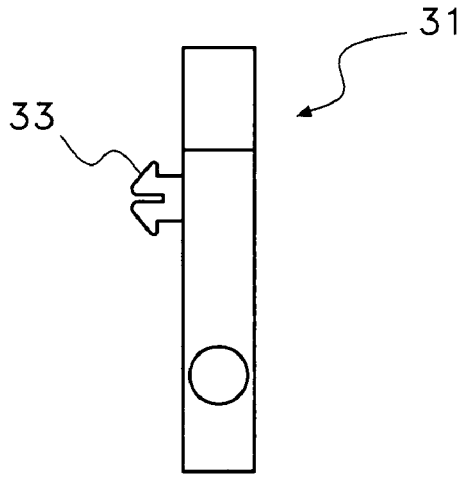
FIG. 7 is a side view of a second exemplary embodiment of a spring anchor mount in accordance with the present invention.

Referring to FIG. 7, an embodiment of a spring anchor mount 31 is shown having an alternate attachment means. The spring anchor mount 31 of FIG. 7 has the same structure as that previously described in FIG. 6, except the embodiment of FIG. 7 does not have mounting holes. Rather, a locking protrusion 33 extends from the rear surface of the spring anchor mount 31. The locking protrusion passes into a hole preformed in the frame of the window, thereby setting the spring anchor mount 31 in a fixed position.

Figure 8:
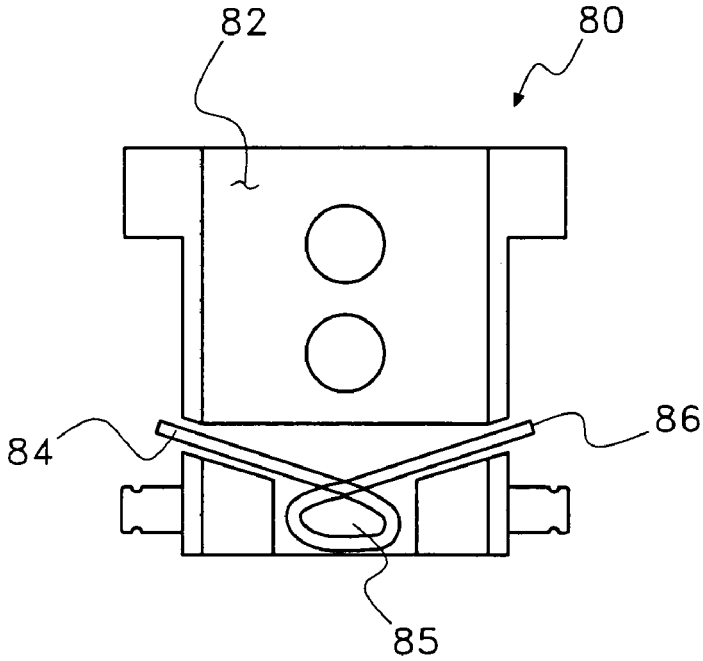
FIG. 8 is a front view of a third exemplary embodiment of a spring anchor mount containing a locking mechanism.

Referring now to FIG. 8, another alternate embodiment of the spring anchor mount 80 is shown. In this embodiment, the spring anchor mount 80 still has a recess 82 that enables a window sash tilt latch to pass the spring anchor mount 80 without contacting the spring anchor mount 80. However, in the shown embodiment, the spring anchor mount 80 is not attached to the window track with mounting screws. Rather, the spring anchor mount 80 is provided with a looped wire locking system very similar to that already described with reference to the brake mechanism of FIGS. 3, 4 and 5.

In the spring anchor mount 80 is a looped wire 84. The ends 86 of the looped wire 84 extend out of the sides of the spring anchor mount 80 unless the loop 85 in the center of the looped wire 84 is internally expanded. A key or screwdriver head is inserted into the loop 85 of the looped wire 84. Once a key or screwdriver head is inserted into the loop 85, the key or screwdriver head is turned. When the key or screwdriver head is turned, the loop 85 expands and the ends 86 of the looped wire 84 retract into the spring anchor mount 80.

To install the spring anchor mount 80, a screwdriver head or other key is placed in the loop 85 of the looped wire 84 and turned. This retracts the ends 86 of the looped wire 84. Once the ends 86 of the looped wire 84 are retracted, the spring anchor mount 80 can be moved to any desired position in the window track. Once in a desired position, the key or screwdriver head is removed and the ends of the looped wire 84 extend and engage the sides of the window track, thereby locking the spring anchor mount 80 in place.

Figure 9:
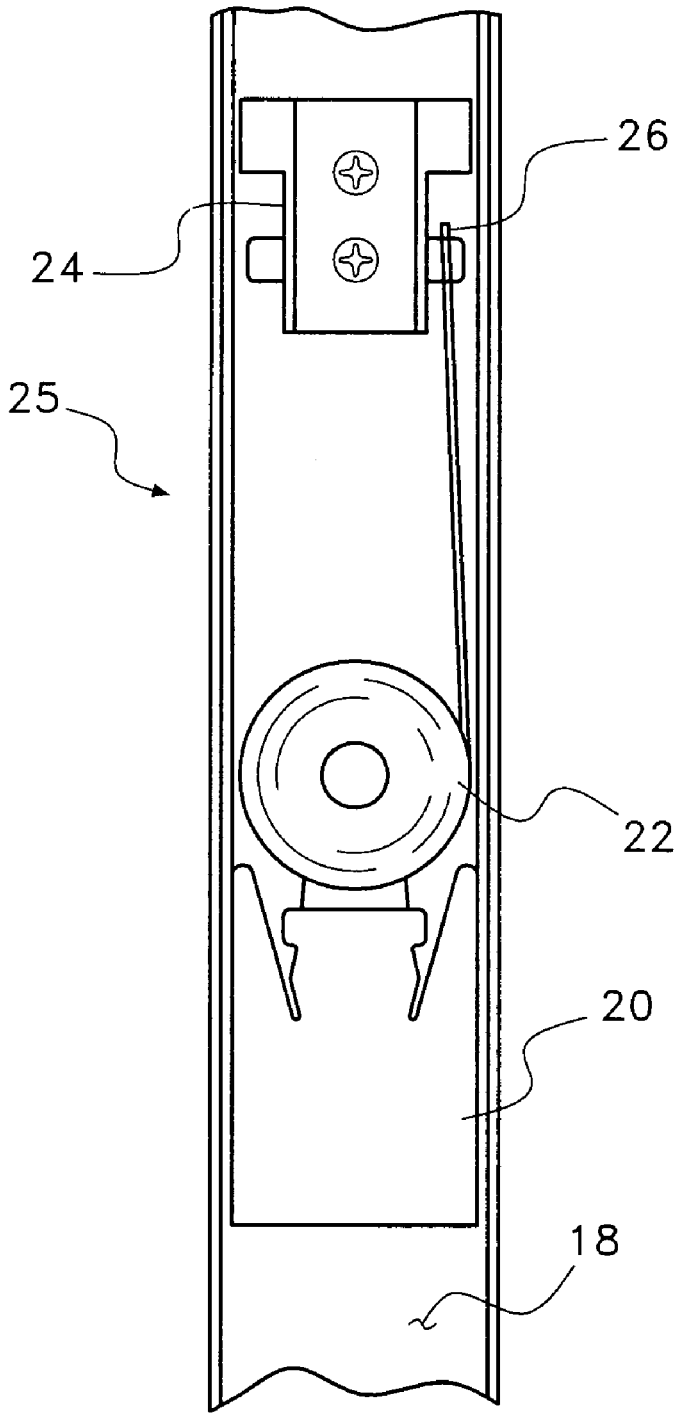
FIG. 9 is a front view of a counterbalance system having a single moving curl spring.

Referring to FIG. 9, a counterbalance system 25 is illustrated in accordance with the present invention. The counterbalance system 25 is being applied to a window assembly having a counterbalance operating system where the curl springs 22 used to create the counterbalance force move with the sash of the window.

From FIG. 9, it can be seen that the curl spring 22 is attached to the shoe assembly 20 so that the curl spring 22 moves with the shoe assembly 20 in the track 18 of the window. The free end 26 of the curl spring 22 is drawn away from the curl spring 22 and is attached to a spring anchor mount 24. The spring anchor mount 24 is mounted in a fixed location to the window frame using one of the mounting systems previously described. The curl spring 22 and the shoe assembly 20 glide up and down in the track 18 with the movement of a window sash. The shoe assembly 20 locks in place when the window sash is tilted, as has previously been explained.

It will be understood that the embodiments of the present invention counterbalance system and its components that are described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

What is claimed is:

1. In a tilt-in window having sashes that ride in tracks in a window frame, wherein said sashes have tilt latches that extend a predetermined distance into said tracks, a spring anchor mount for holding springs used to counterbalance the sash, said spring anchor mount comprising:

a body having a top and a bottom, wherein said body defines a recessed area that extends from said top to said bottom that is recess a depth longer than said predetermined distance;

a mounting structure for mounting said body in a fixed position within the window track; and a retaining structure of coupling said body to a curl spring.

2. The spring anchor mount according to claim 1, wherein said body has side walls and said retaining structure for coupling said body to a curl spring is disposed on said side walls.

3. The spring anchor mount according to claim 2, wherein said retaining structure includes protrusions that extend from said side walls.

4. The spring anchor mount according to claim 1, wherein said mounting structure is at least one screw hole.

5. The spring anchor mount according to claim 1, wherein said mounting structure includes a retractable locking mechanism that can be selectively configured to lock said body in a fixed position within the window track.

6. The spring anchor mount according to claim 1 wherein said mounting structure includes a spring having a first end and a second end, wherein said spring forms a loop between said first end and said second end, said spring being disposed in said body, wherein said first end and said second end of said spring extend out of said body and wherein said first end and said second end of said spring retract back into said body when said loop of said spring is expanded.

7. In a tilt-in window assembly having a window sash with a pivot post that extends from the window sash, a shoe assembly for use in a counterbalance system for the window sash, said shoe assembly comprising:

a shoe body having a face surface, a rear surface and two side surfaces that extend between said face surface and said rear surface;

an internal chamber defined within said shoe body between said face surface and said rear surface, wherein said internal chamber is accessible through opposing holes in said side surfaces of said shoe body;

a post access hole disposed in said face surface of said shoe body that intersects said internal chamber;

a spring having a first end and a second end, wherein said spring forms a loop between said first end and said second end, said spring being disposed in said internal chamber, wherein said first end and said second end of said spring extend out of said internal chamber through said opposing holes in said side surfaces, and wherein said first end and said second end of said spring retract back into said shoe body when said loop of said spring is expanded within said internal chamber.

8. The shoe assembly according to claim 7, wherein the pivot post of the window sash passes into said loop through said post access hole and expands said loop when the window sash is not tilted.

9. The shoe assembly according to claim 7, wherein said spring is comprised of a single strand of formed wire.

10. The shoe assembly according to claim 7, further including at least one rib protrusion extending from each of said side surfaces.

11. A shoe assembly for a tilt-in window counterbalance system, comprising:

a shoe body having a face surface, a rear surface and two side surfaces that extend between said face surface and said rear surface;

at least one rib protrusion extending from each of said side surfaces, wherein said at least one rib protrusion has a width smaller than that of said side surfaces and prevents said side surfaces from directly wearing against another surface; and a brake mechanism for locking said shoe assembly in a set position when the sash of the tilt-in window is tilted, said brake mechanism including a looped wire spring having two opposing arms that are positionable in an extended position and a retracted position, wherein arms of said looped wire spring extend beyond said rib protrusions when in said extended position, and wherein said arms of said looped wire spring do not extend beyond said rib protrusions when in said retracted position.

* * * * *